US006666180B2

(12) United States Patent
Hase

(10) Patent No.: US 6,666,180 B2
(45) Date of Patent: Dec. 23, 2003

(54) VALVE TIMING CONTROL DEVICE

(75) Inventor: Hirofumi Hase, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 31 days.

(21) Appl. No.: 10/121,590

(22) Filed: Apr. 15, 2002

(65) Prior Publication Data

US 2003/0070638 A1 Apr. 17, 2003

(30) Foreign Application Priority Data

Oct. 16, 2001 (JP) ..... 2001-318427

(51) Int. Cl.[7] ..... F01L 1/34

(52) U.S. Cl. ..... 123/90.17; 123/90.15; 123/90.37

(58) Field of Search ..... 123/90.15–90.18, 123/90.37; 92/86, 120–125

(56) References Cited

U.S. PATENT DOCUMENTS 5,492,051 A * 2/1996 Schiffler et al. ..... 92/125
5,797,363 A * 8/1998 Nakamura ..... 123/90.17
5,875,750 A * 3/1999 Iwasaki et al. ..... 123/90.17
6,325,032 B1 * 12/2001 Sekiya et al. ..... 123/90.17

FOREIGN PATENT DOCUMENTS

| | | |
|---|---|---|
| JP | 9-112223 | 4/1997 |
| JP | 10-227205 | 8/1998 |
| JP | 11-13432 | 1/1999 |
| JP | 2000-130119 | 5/2000 |

* cited by examiner

*Primary Examiner*—Thomas Denion
*Assistant Examiner*—Kyle Riddle
(74) *Attorney, Agent, or Firm*—Sughrue Mion, PLLC

(57) ABSTRACT

A valve timing control device according to the present invention has a between-sealing-faces clearance defined between a frontal end of each shoe of a first rotor and an outer periphery of a boss section of a second rotor corresponding to the frontal end of the shoe and accepting the quantity of oil leaks having no effect on the responsibility of the device as a maximum value. The between-sealing-faces clearance is so set as to be larger than the maximum bearing clearance defined between the camshaft and a bearing section of the device supporting rotationally the camshaft.

3 Claims, 7 Drawing Sheets

VALVE TIMING CONTROL DEVICE

BACKGROUND OF THE INVENTION

1. Field of the Invention

The present invention relates to a valve timing control device (hereafter, referred as a device) altering timing for the closing and opening of an exhaust valve or intake valve of an internal-combustion engine (hereafter, referred as an engine) with reference to any operating conditions.

2. Description of the Related Art

FIG. 1 is a lateral cross sectional view of an internal configuration of a related valve timing control device. FIG. 2 is a longitudinal cross sectional view of the internal configuration of the related valve timing control device shown in FIG. 1. In the drawings, a reference numeral 1 denotes a first rotor, which is coupled to a crankshaft (not shown) as an output shaft of the engine by way of chains (not shown) and is rotatable in synchronization with the crankshaft (not shown). The first rotor 1 is integrated with a sprocket 2, a case 3 and a cover 4 using a threaded member 5 such as bolts. The sprocket 2 is rotated integrally with the crankshaft (not shown). The case 3 has a plurality of shoes 3*a* projected inwardly from an inner periphery of the case 3 to constitute a plurality of hydraulic chambers. The hydraulic chambers are blocked with the cover 4.

A rotor (second rotor) 6 is rotated relative to the first rotor 1 and is disposed in the case 3. The rotor 6 is integrally fixed on one end of an intake camshaft (hereafter, referred simply as a camshaft 7), which relates to timing for the closing and opening of an intake valve (not shown), or an exhaust camshaft (hereafter, referred simply as a camshaft 7), which relates to timing for the closing and opening of an exhaust valve (not shown), using a threaded member (not shown) such as bolts. The rotor 6 includes a boss section 6*a* having a bearing section 6*b*, which allows insertion of the one end of the camshaft 7, and a plurality of vanes 6*c* projected outwardly from an outer periphery of the boss section 6*a* in a radial direction of the boss section 6*a* to partition the hydraulic chambers, which are constituted by the shoes 3*a* of the case 3, into an advanced side hydraulic chamber 8 and a retarded side hydraulic chamber 9. The advanced side hydraulic chamber 8 means a hydraulic chamber to which a hydraulic pressure is supplied in order to move relatively the rotor 6, which is located at a reference position with respect to the case 3 shown in FIG. 1, toward the advanced side (in a direction of arrow X1) when the first rotor 1 including the case 3 rotates in the direction of arrow X1 shown in FIG. 1. On the other hand, the retarded side hydraulic chamber 9 means a hydraulic chamber to which a hydraulic pressure is supplied in order to move relatively the rotor 6, which is located at the reference position with respect to the case 3 shown in FIG. 1, toward the retarded side (in a direction of arrow X2) when the first rotor 1 including the case 3 rotates in the direction of arrow X1 shown in FIG. 1.

A first oil path 10 is arranged in the sprocket 2 and supplies a hydraulic pressure derived from an oil pump (not shown) to the advanced side hydraulic chamber 8 through an oil control valve (not shown) and an advanced side oil path (not shown) in the camshaft 7. A second oil path 11 is arranged in the rotor 6 and supplies a hydraulic pressure derived from the oil pump (not shown) and so on to the retarded side hydraulic chamber 9 through a retarded side oil path (not shown) in the camshaft 7.

An accommodation hole 13 accommodating a locking pin 12, which controls a relative rotation of the case 3 and the rotor 6, is so arranged at one of the shoes 3*a* of the case 3 as to pierce the case 3 in the radial direction.

Here, when the engine is started without producing a hydraulic pressure in the device, the rotor 6 vibrates in rotational directions due to a load of a cam (not shown) which is fixed integrally at the camshaft 7. Due to the vibration, contact and separation between the rotor 6 and the case 3 are repeated, and accordingly a beat noise occurs. The locking pin 12 prevents the occurrence of such a beat noise. The locking pin 12 includes a frontal minor-diameter section 12*a* allowing insertion into an engagement hole described later, a rear major-diameter section 12*b* having an outer diameter larger than the frontal minor-diameter section 12*a*, and a recess 12*c* formed at a rear bottom of the rear major-diameter section 12*b*.

The accommodation hole 13 includes a minor-diameter hole section 13*a* accommodating the frontal minor-diameter section 12*a* of the locking pin 12, and a major-diameter hole section 12*b* with an inner diameter larger than that of the minor-diameter hole section 13*a*, the section 12*b* accommodating the rear major-diameter section 12*b* of the locking pin 12. A passage-selectable valve 16 is arranged at a position, which is adjacent to the shoe 3*a* equipped with the accommodation hole 13, of an end of the sprocket 2 close to the case 3. The passage-selectable valve 16 selects the higher hydraulic pressure of the two different pressures in the advanced and retarded hydraulic chambers 8 and 9, and supplies the selected pressure to a hydraulic chamber 15 defined between a frontal end face of the rear major-diameter section 12*b* of the locking pin 12 and a frontal end face of the major-diameter hole section 13*b* of the accommodation hole 13 by way of a hydraulic pressure supply passage 14 to unlock an engagement (hereafter, referred as a locking relation) of the locking pin 12 with the engagement hole described later. An advanced side hydraulic partitioned passage 17 communicates between the passage-selectable valve 16 and the advanced side hydraulic chamber 8, and a retarded side hydraulic partitioned passage 18 communicates between the passage-selectable valve 16 and the retarded side hydraulic chamber 9.

A prevention holder 21 is press-fitted in an outer periphery (outermost section of the device) of the major-diameter section 13*b* of the accommodation hole 13. The prevention holder 21 prevents the locking pin 12 and a coil spring 20 biasing the locking pin 12 against the rotor 6 at all times from being ejected out of the outermost section of the device. The prevention holder 21 is fixed at an outer periphery of the major-diameter section 13*b* of the accommodation hole 13 using a prevention pin 22. A discharge hole 23 is formed at a central section of the prevention holder 21 and discharges a backward pressure, which is produced in the accommodation hole 13 when the locking pin 12 moves back, to outside of the device. Moreover, the coil spring 20 is arranged between the recess 12*c* of the locking pin 12 and the prevention holder 21.

On the other hand, an engagement hole 24 is formed inwardly at a position, where the engagement hole 24 allows insertion of the frontal minor-diameter section 12*a* of the locking pin 12 when the rotor 6 is located at the reference position (most retarded position in FIG. 1) with respect to the case 3, of an outer periphery of the boss section 6*a* of the rotor 6 in the radial direction.

Seal means 25 are disposed at frontal ends of the respective vanes 6*c* of the rotor 6, and make contact with an inner periphery of the case 3 corresponding to each vane 6*c* to prevent oil leaks through a boundary between the advanced and retarded hydraulic chambers 8 and 9.

Incidentally, with a general device, speaking of the related device, a seal means like the seal mean above is often disposed at each of frontal ends (section A in FIG. 1) of each shoe 3*a*, which is located inside each of frontal ends of the respective vanes 6*c*. With one device, the seal means disposed at the section A positioned inside the device are however decommissioned in order to reduce cost of parts and so on and to simplify the structure of device as in the case of the related device. The device is constructed on premises that an infinitesimal clearance defined between the frontal end (case-side sealing face) of the shoe of the case and the outer periphery (rotor-side sealing face) of the boss section of the rotor serves a function of sealing between the chambers 8 and 9.

By definition, the purpose of preventing the oil leaks through the boundary between the advanced and retarded side hydraulic chambers 8 and 9 is to prevent a responsibility of the device from reduction due to reduction of the hydraulic pressure in the hydraulic chambers with the oil leaks. However, there is a possibility that the reduction of hydraulic pressure in each hydraulic chamber occurs due to other facts. Speaking of the example as shown in FIG. 1, as the flowability of actuating oil is increased at an elevated temperature of the oil, the oil flow between the chambers 8 and 9 in a peripheral direction of arrow B through an axial-direction clearance (hereafter, referred as a side clearance). Here, the side clearance is defined between the sprocket 2 and the case 3 or the rotor 6 or between the cover 4 and the case 3 or the rotor 6. As a result, there is the possibility that the reduction of hydraulic pressure in each hydraulic chamber occurs.

JP-A-130119/2000 discloses one side face, which faces the side clearance, of the sprocket 2 or the cover 4 is made of materials having a high thermal coefficient of expansion. In such a case, the one side face of the sprocket 2 or the cover 4 expands at the elevated temperature of the actuating oil and prevents the hot oil from passing through the side clearance.

However, it is possible to prevent the flow, which is indicated by arrow B in FIG. 1, of oil passing through the side clearance and the spill of oil in a direction of arrow C using the threaded member 5 without providing with special configurations.

JP-A-227205/1998 also discloses a device having no seal means arranged at the section A shown in FIG. 1. With the valve timing control device, a groove extending in a peripheral direction is arranged at a sliding face, and a roller is arranged rotationally in the groove in the peripheral direction. As a result, there is the possibility of reducing a sliding resistance occurred between a case and a rotor.

However, the related valve timing control device has the configurations as described above. There are problems that parts count and costs cannot be reduced because the roller is used instead of decommissioned seal means.

Moreover, in any of the related valve timing control devices above, when an axis of the device rotates eccentrically or skews on rotation of the engine for example, contact between both sealing face-to-sealing faces occur to wear them. At this time, there are problems that reliability of the device and changes in performance (increasing the quantity of oil leaks) are incurred.

SUMMARY OF THE INVENTION

Accordingly, it is an object of the present invention to provide a valve timing control device allowing control of the quantity of oil leaks, which are derived from the section A arranged inside the device decommissioning the seal means, within acceptable limits and ensuring the reliability of operation.

In order to achieve the object of the present invention, we provide a valve timing control device, a first rotor moving rotationally in synchronization with a crankshaft of an internal-combustion engine and having a plurality of shoes formed at an inner periphery of the first rotor, forming a plurality of hydraulic chambers; a second rotor arranged rotationally in the first rotor with the first rotor, including a boss section fixed at an end face of a camshaft of the internal-combustion engine and a plurality of vanes arranged at an outer periphery of the boss section and partitioning the hydraulic chambers into advanced side hydraulic chambers and retarded side hydraulic chambers; a seal means arranged between an outer periphery of each vane of the second rotor and an inner periphery of the first rotor; and a between-sealing-faces clearance defined between a frontal end of each shoe of the first rotor and the outer periphery of the boss section of the second rotor corresponding to the frontal end of the shoe and accepting the quantity of oil leaks having no effect on the responsibility of the device as a maximum value. In this way, it is difficult for actuating oils to pass through the between-sealing-faces clearance due to viscous resistance of the oils when the temperature of oil in the internal-combustion engine is not so elevated, it is possible to prevent the hydraulic pressure in the hydraulic chambers from reducing. When viscosity of oils is reduced to increase the flowability of oils as the temperature of oils in the engine is increased, a small amount of oil having no effect on the responsibility of the device leak from one of the hydraulic chambers to the other through the clearance. Therefore, it is possible to ensure operating stability of the device without reducing extremely the hydraulic pressure in the hydraulic chambers.

With the above arrangement, the between-sealing-faces clearance may be so set as to be larger than the maximum bearing clearance defined between the camshaft and a bearing section of the device supporting rotationally the camshaft. In this way, when the axis of the device rotate eccentrically within the range of the bearing clearance due to rotation of the crankshaft and soon of the engine, it is possible for the bearing clearance to accommodate relative displacement between parts due to the eccentricity. Therefore, it is possible to prevent sealing faces from wearing without occurrence of the sealing face-to-sealing face contact, including the outer periphery of the boss section of the second rotor and the frontal end of each shoe of the first rotor. Therefore, it is possible to improve the reliability of the device.

With the above arrangement, it may further comprise at least one oil-accumulation groove arranged at any one or both of the outer periphery of the boss section of the second rotor and the frontal end of each shoe of the first rotor. In this way, it is possible to cause a loss of kinetic energy of oils due to contraction within the oil-accumulation groove. Therefore, it is possible to reduce the quantity of oil leaks without adding complicated structure for blocking the flow of oil between the hydraulic chambers.

With the above arrangement, it may further comprise a recess arranged at any one of the outer periphery of the boss section of the second rotor and the frontal end of each shoe of the first rotor, and a projection arranged at the other and allowing insertion of the projection into the recess. In this way, it is possible to lengthen oil passages of the actuating oil between the sealing faces. Therefore, it is possible to increase the resistance to the flow of oil between the sealing faces including the recess and the projection to reduce the quantity of oil leaks.

DESCRIPTION OF THE PREFERRED EMBODIMENT OF THE INVENTION

Embodiments of the present invention will be hereafter explained.

Embodiment 1

Figure 1:
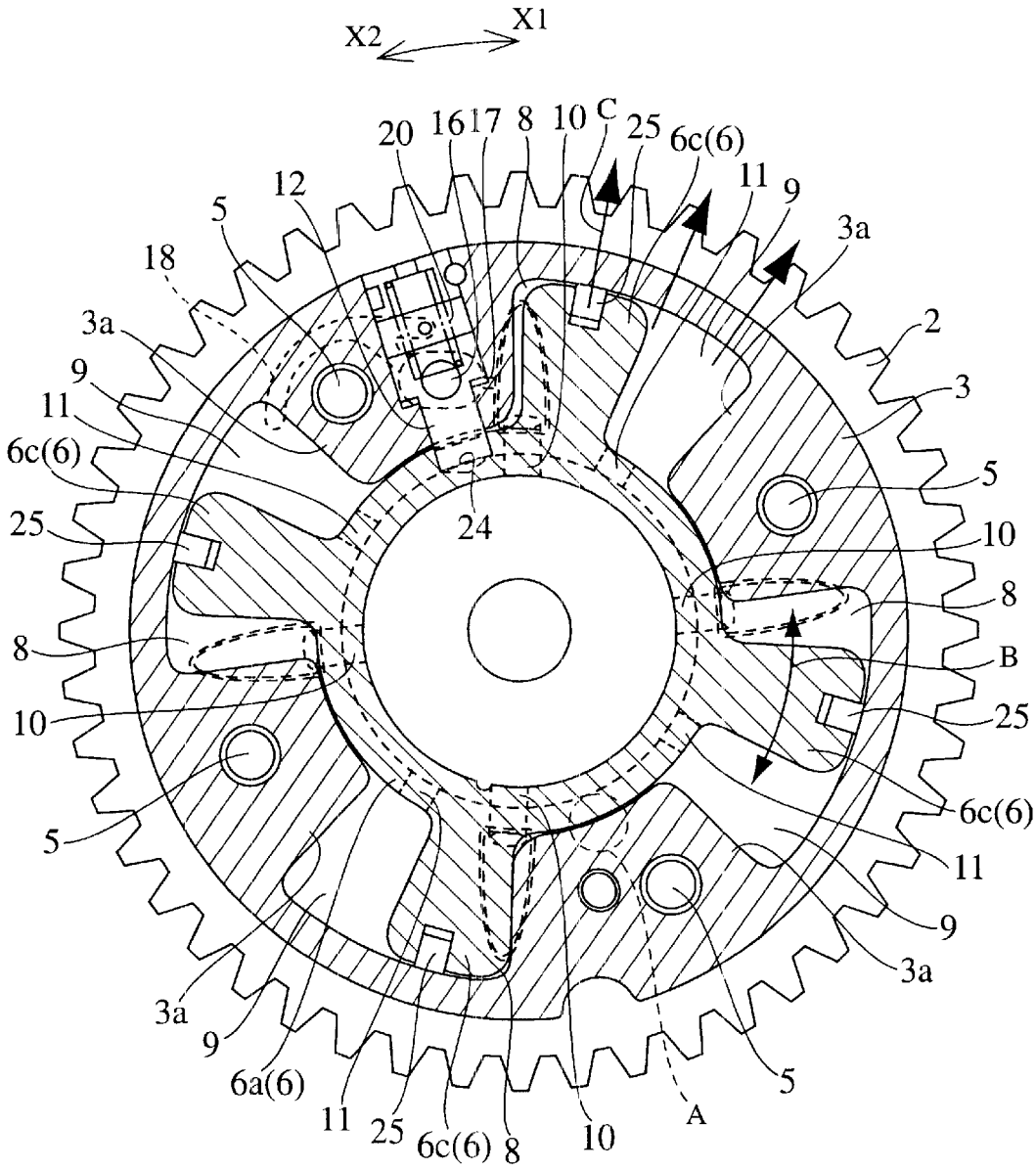
FIG.1 (PRIOR ART)
FIG. 1 is a lateral cross sectional view of an internal configuration of a related valve timing control device.
Figure 2:
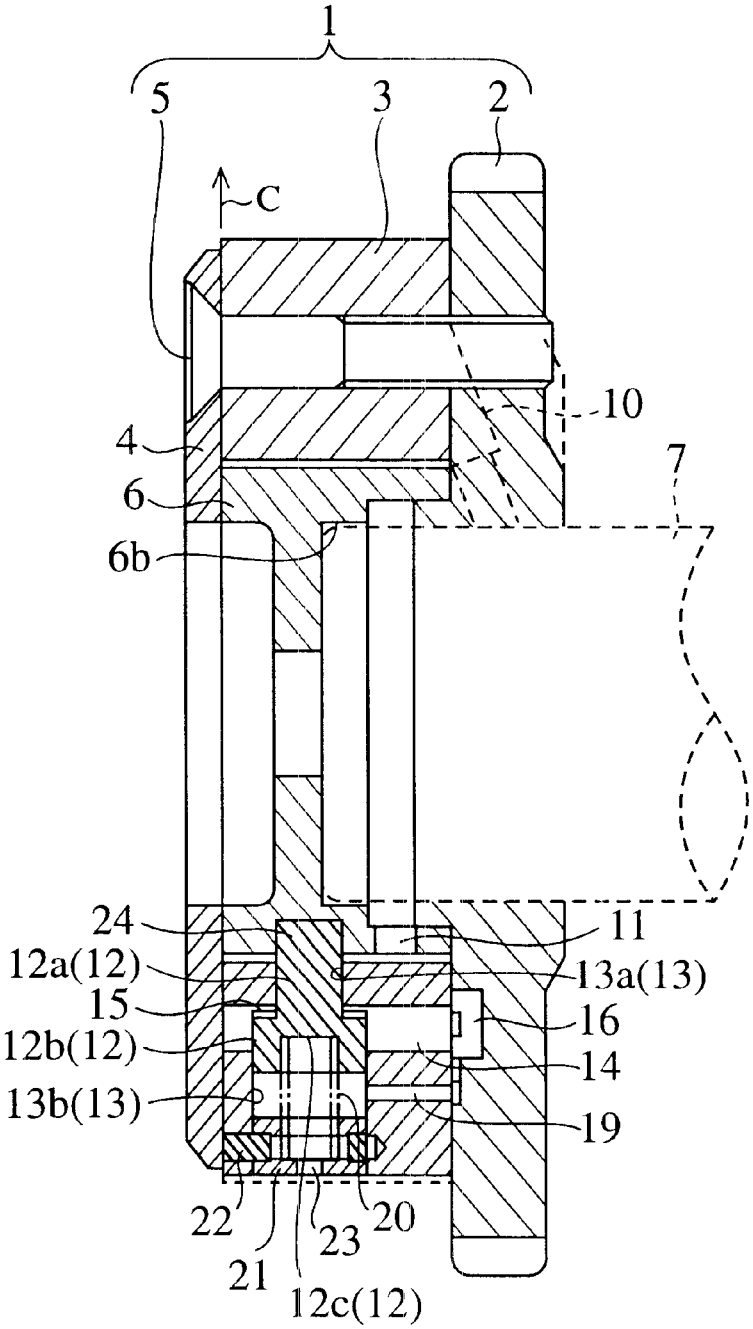
FIG.2 (PRIOR ART)
FIG. 2 is a longitudinal cross sectional view of the internal configuration of the related valve timing control device shown in FIG. 1.
Figure 3:
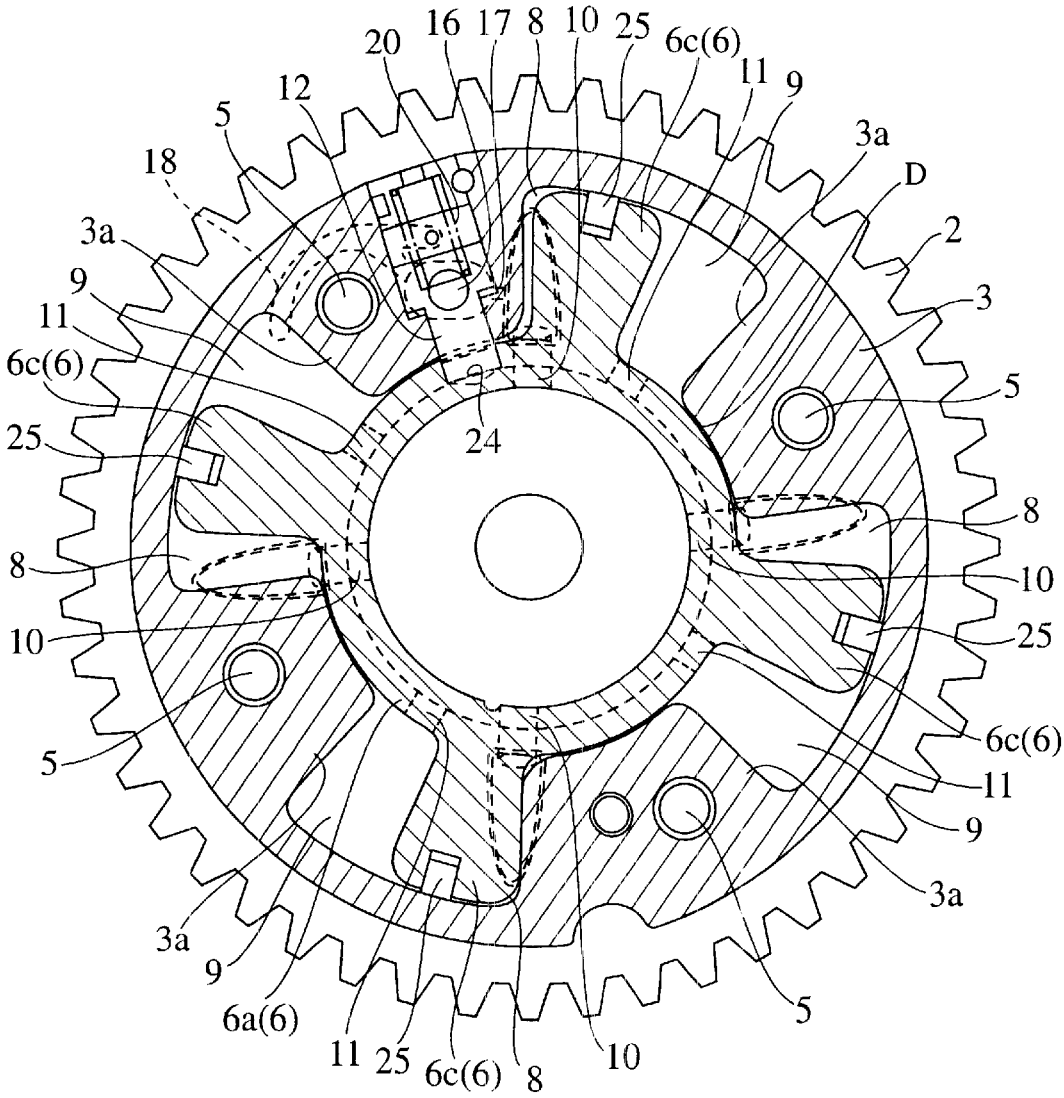
FIG. 3 is a lateral cross sectional view of an internal configuration of a valve timing control device as embodiment 1 according to the present invention.
Figure 4:
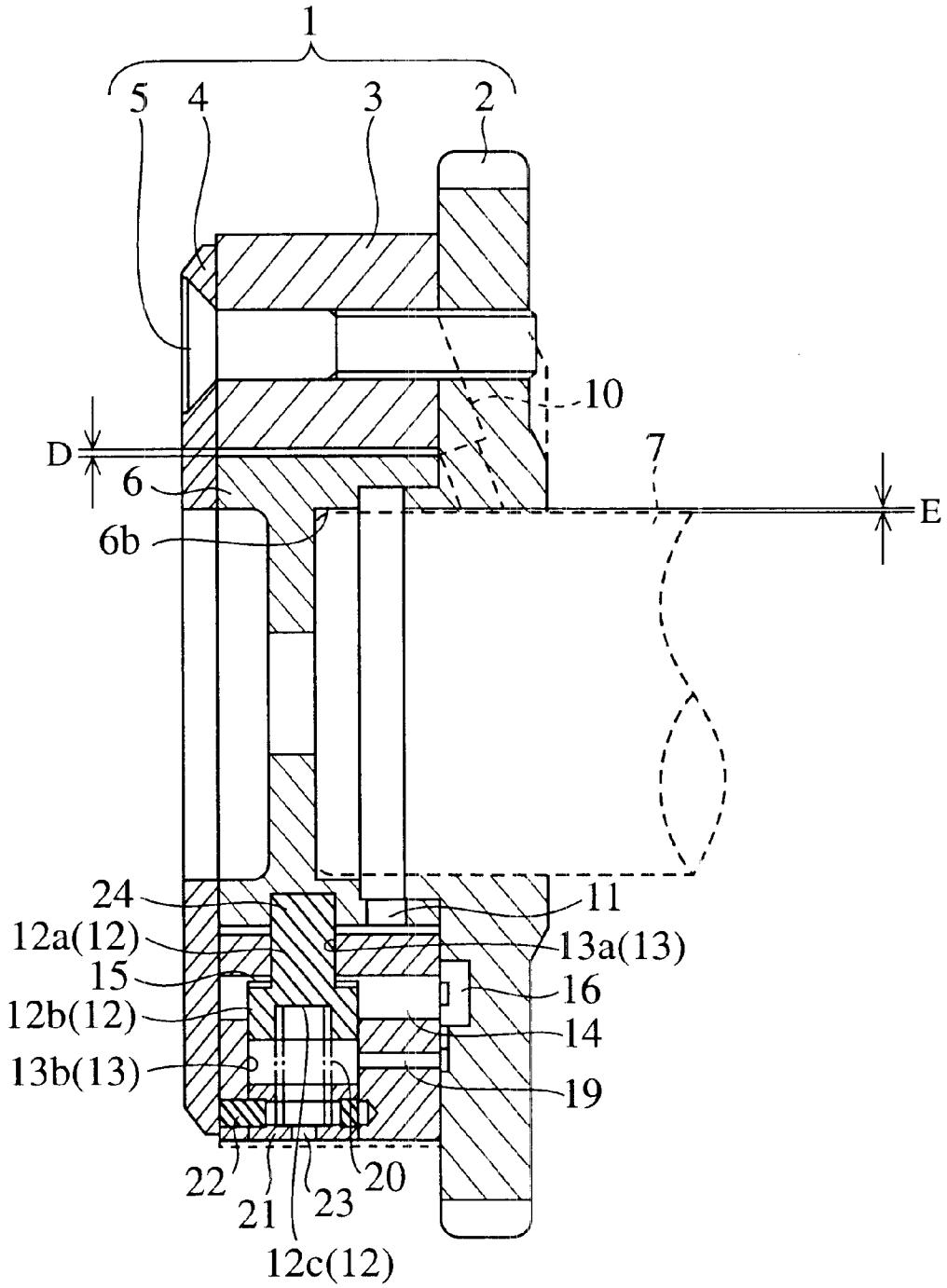
FIG. 4 is a longitudinal cross sectional view of the internal configuration of the related valve timing control device shown in FIG. 3.
Figure 5:
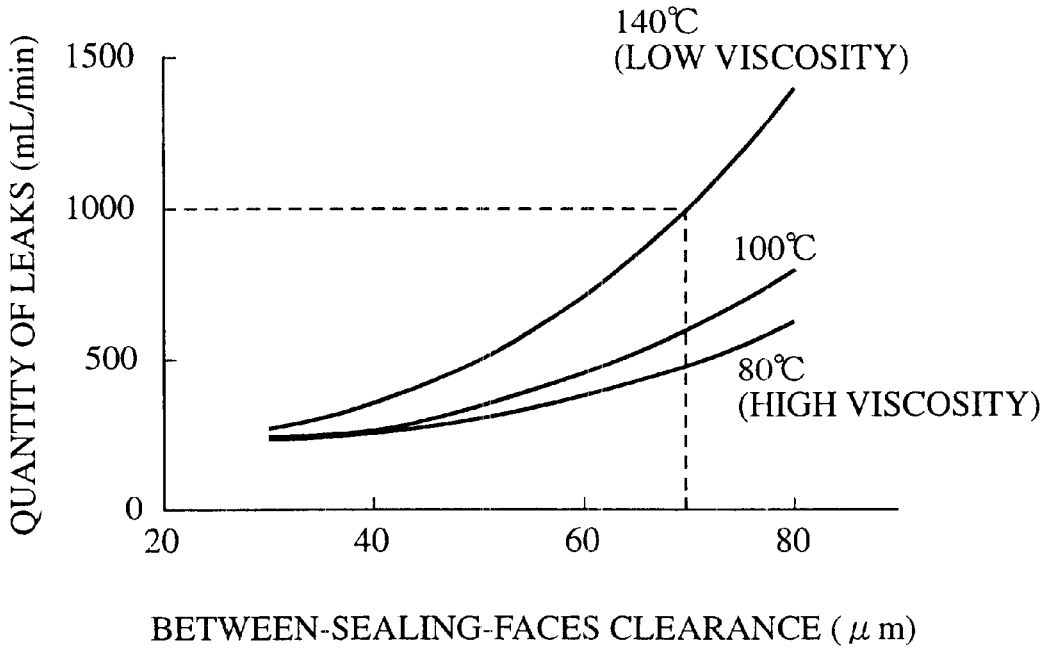
FIG. 5 is a graph of a between-sealing-faces clearance in the valve timing control device shown in FIG. 3 and FIG. 4 and the quantity of flow of actuating oil leaks varying with reference to change of temperature of the actuating oil.

FIG. 3 is a lateral cross sectional view of an internal configuration of a valve timing control device as embodiment 1 according to the present invention. FIG. 4 is a longitudinal cross sectional view of the internal configuration of the related valve timing control device shown in FIG. 3. FIG. 5 is a graph of a between-sealing-faces clearance in the valve timing control device shown in FIG. 3 and FIG. 4 and the quantity of flow of actuating oil leaks varying with reference to change of temperature of the actuating oil. Components of the embodiment 1 common to those of the related valve timing control device are denoted by the same reference numerals and further description will be omitted.

The embodiment 1 is firstly characterized in that a between-sealing-faces clearance D is defined between the frontal end of the shoe 3*a* and the outer periphery of the boss section 6*a* facing the frontal end of the shoe 3*a* as shown in FIG. 3 and FIG. 4. The embodiment 1 is constructed on premises that placement of seal means in the frontal end of the shoe 3*a* of the case 3 is decommissioned as in the case of the related valve timing control device. The between-sealing-faces clearance D accepts the quantity of oil leaks having no effect on the responsibility of the device as a maximum value even when the viscosity of oil is low due to the elevated temperature of the actuating oils.

Here, the quantity of oil leaks is determined due to the temperature of actuating oils and the size of the between-sealing-faces clearance D. In other words, when the temperature of actuating oils becomes higher, the viscosity of fluid becomes lower. Therefore, since the flowability of actuating oils is increased, the oils easily pass through the between-sealing-faces clearance D. Moreover, when the between-sealing-faces clearance D is increased in size, oil leak is increased in quantity in response to the size of the between-sealing-faces clearance D. For example, if, when a hydraulic pressure is applied to the advanced side hydraulic chamber 8, the applied oil is leaked to an adjacent retarded side hydraulic chamber 9 through the between-sealing-faces clearance D, the hydraulic pressure in the advanced side hydraulic chamber 8 is lower than a predetermined pressure. It is desirable that the quantity of oil leaks is little. However, the reduction of hydraulic pressure due to the oil leak is not directed to have no effect on the responsibility of the device. Conversely, if extreme reduction of hydraulic pressure having effect on the responsibility of the device is not occurred, it is possible to accept the oil leak as a cause of the reduction of hydraulic pressure.

Assume that an acceptable maximum quantity of oil leaks is set to 1000 mL/min. The between-sealing-faces clearance D must be so determined that the quantity of oil leaks at a maximum temperature of 140° C., which lowers the viscosity of the oil to increase the flowability thereof, of the oil in actual devices falls short of the acceptable maximum. In this case, as indicated by a broken line of FIG. 5, the upper limit of the between-sealing-faces clearance D, which satisfies the condition above, becomes 70 $\mu$m for example.

The embodiment 1 is secondarily characterized in that the between-sealing-faces clearance D is set to be larger than a clearance E between an outer periphery of a mounting section of the camshaft 7 and an inner periphery of the bearing section 6*b* of the rotor 6 as shown in FIG. 4. In this way, when the axis of the device rotates eccentrically or skews with respect to the camshaft 7, due to the clearance E (looseness), it is possible to prevent both sealing face-to-sealing faces, which constitutes the between-sealing-faces clearance D, from contact and wearing. It is further possible to prevent the quantity of oil leaks due to the wearing of the both sealing face-to-sealing faces, to improve durability and reliability of the device, and to ensure performance of the device.

An operation will be explained hereafter.

Due to the lowering of the viscosity of the actuating oil at the elevated temperature, the actuating oil in the advanced or retarded side hydraulic chamber 8 or 9 becomes to pass easily through the between-sealing-faces clearance D. Since the between-sealing-faces clearance D is however set to the required range, the quantity of oil leaks has no effect on the responsibility of the device.

As described above, according to the embodiment 1, since the between-sealing-faces clearance D is set to the required range above, it is possible to determine the quantity of oil leaks under the worst condition including the elevated temperature and so on of the actuating oil. Even if oil properties of vary due to the temperature of the actuating oil or another conditions, it is possible to prevent a response speed of the device from reduction due to increase of the quantity of oil leaks. It is possible to prevent a hydraulic pressure of the engine from reduction to ensure lubricating effect in the engine with reliability.

Moreover, with the embodiment 1, each clearance D is arranged inside of the device close to the central portion of the device, and each seal means 25 is arranged at a position apart from the central portion of the device. With the arrangement, considering that mechanical accuracy regarding an inner section of the device is better than mechanical accuracy regarding an outer section of the device and that influence on contact of the sealing faces in the inner section is smaller than the outer section on skewing of the device. As a result, the embodiment 1 indicates the best mode of the embodiments.

Embodiment 2

Figure 6:
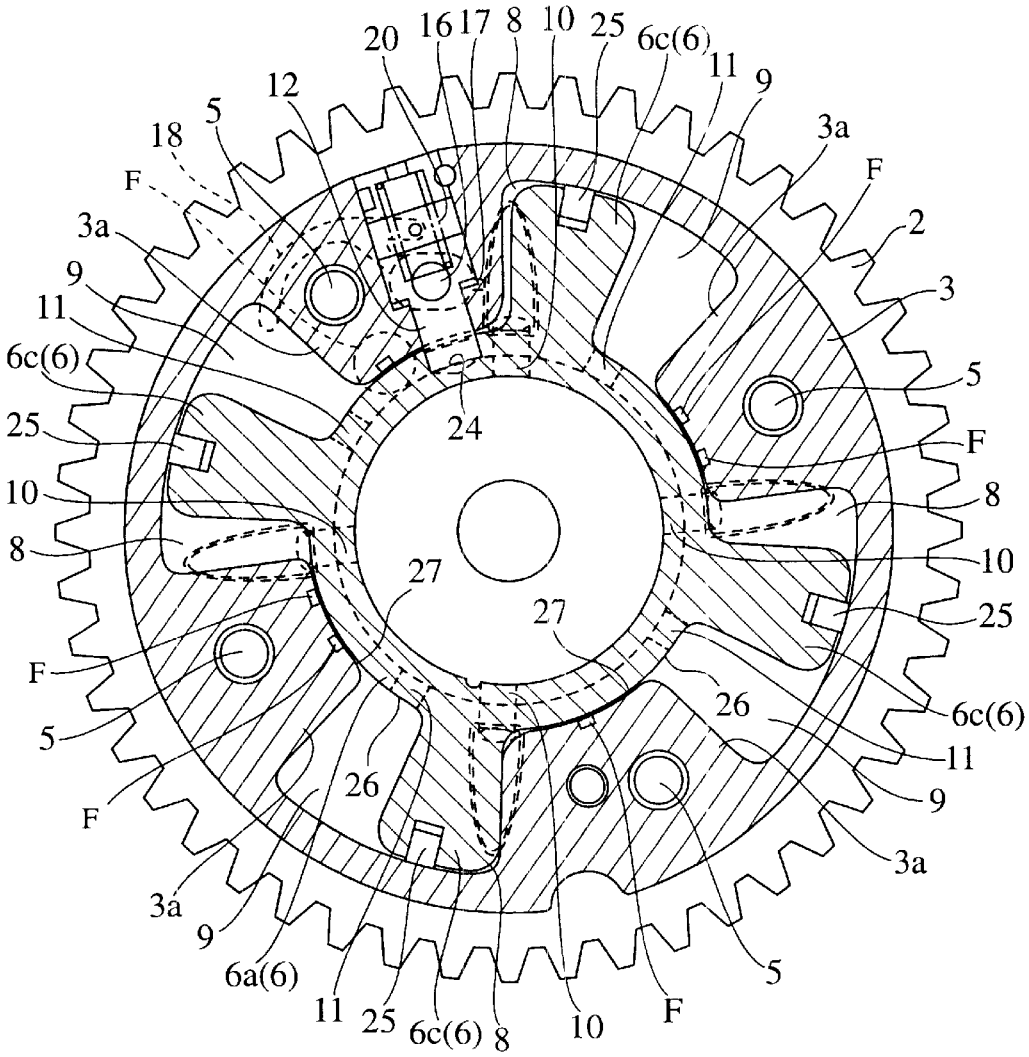
FIG. 6 is a lateral cross sectional view of an internal configuration of a valve timing control device as embodiment 2 according to the present invention.
Figure 7:
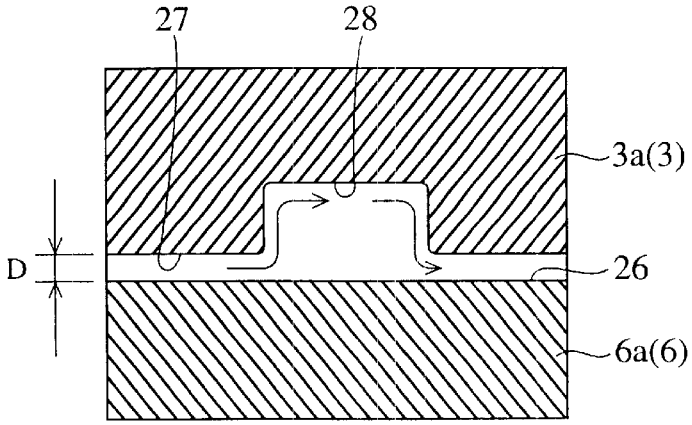
FIG. 7 is an enlarged, lateral cross sectional view of an important point F in the valve timing control device shown in FIG. 6.

FIG. 6 is a lateral cross sectional view of an internal configuration of a valve timing control device as embodiment 2 according to the present invention. FIG. 7 is an enlarged, lateral cross-sectional view of an important point F in the valve timing control device shown in FIG. 6. Components of the embodiment 2 common to those of the related valve timing control device or those of the embodiment 1 are denoted by the same reference numerals and further description will be omitted.

With the embodiment 2, assume the between-sealing-faces clearance D, which is defined between an outer peripheral face 26 of the boss section 6*a* of the rotor 6 and a frontal end 27 of the shoe 3*a* of the case 3, is adjusted to the range set in the embodiment 1. The embodiment 2 is characterized in that at least one oil-accumulation groove 28 is arranged at the frontal end 27 of the shoe 3*a* of the case 3 facing the outer peripheral face 26 of the boss section 6*a* of the rotor 6. Moreover, with the embodiment 2, one of the oil-accumulation grooves 28 is arranged at alternative sealing face-to-sealing faces, and two grooves 28 are arranged between them. The layout of the grooves 28 is not limited to the arrangement above. The groove 28 may be formed integrally with the case 3 when the case 3 is manufactured due to molding or forging.

An operation will be explained hereafter.

When the actuating oil in the advanced or retarded hydraulic chamber 8 or 9 passes through the between-sealing-faces clearance D and the oil-accumulation groove 28 as shown by arrow of FIG. 7, the oil comes into collision with walls constituting the oil-accumulation groove 28. As a result, the oil contracts to lose kinetic energy in addition to undergoing friction resistance due to the viscosity of the oil at a temperature. In this way, it is possible to reduce the quantity of oil leaks.

As described above, according to the embodiment 2, since the oil-accumulation groove 28 is arranged at the between-sealing-faces clearance D, it is possible to cause the loss of kinetic energy of oils due to contraction of the oil within the oil-accumulation groove 28. Therefore, it is possible to reduce the quantity of oil leaks. In this way, it is possible to keep a responsibility of the device at a high level without reducing extremely the hydraulic pressure.

With the embodiment 2, when the case 3 is manufactured due to molding or forging to form integrally the oil-accumulation groove 28 at the case 3, it is possible to reduce the quantity of oil leaks without increasing the cost of manufacturing.

Moreover, with the embodiment 2, the oil-accumulation groove 28 is arranged on the shoe 3*a* side of the case 3. Alternatively, the oil-accumulation groove 28 may be arranged on the outer peripheral face of the boss section 6*a* of the rotor 6 facing the shoe 3*a* of the case, or on both sides thereof. It is desirable that a shape of the oil-accumulation groove 28 in cross section is so formed that the ratio of width to depth becomes larger.

Embodiment 3

Figure 8:
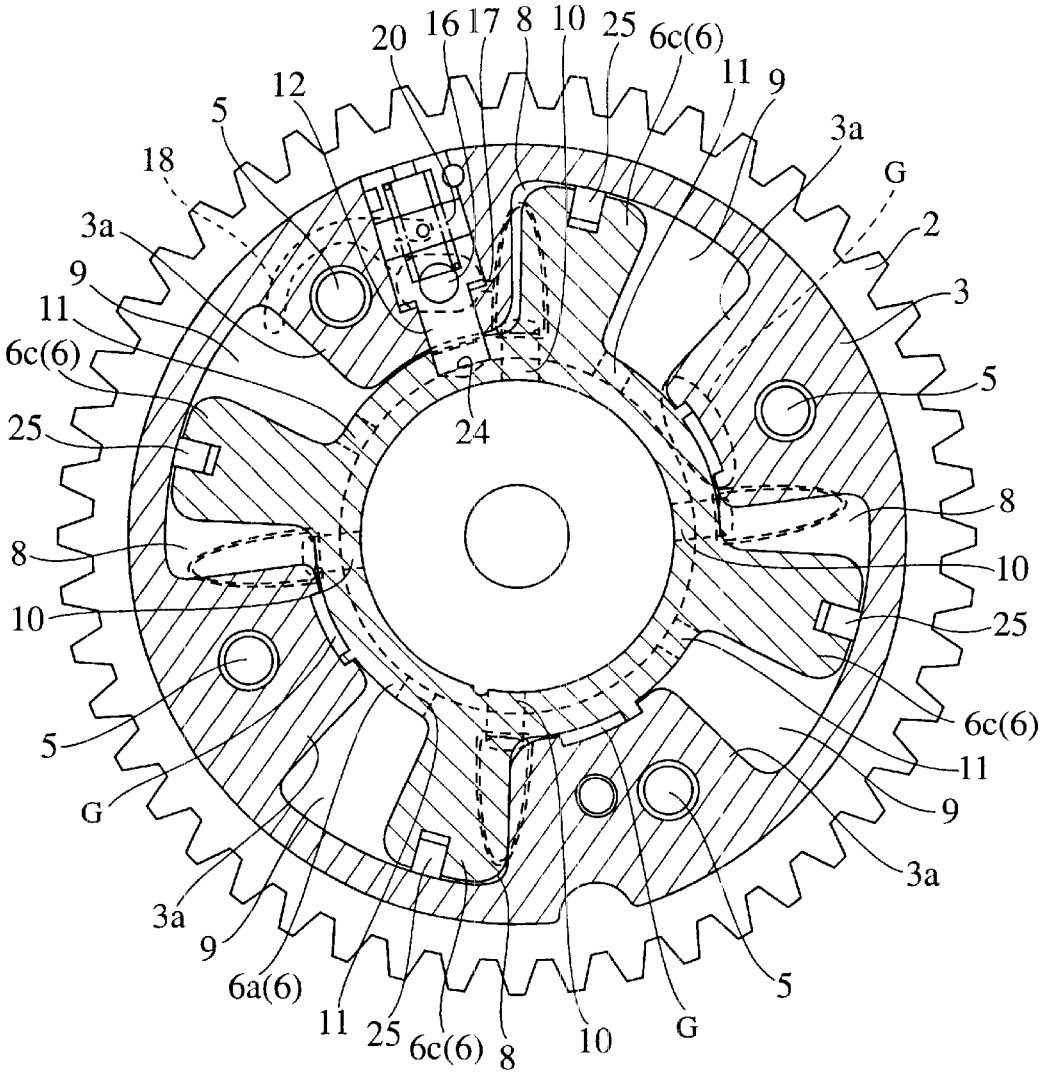
FIG. 8 is a lateral cross sectional view of an internal configuration of a valve timing control device as embodiment 3 according to the present invention.
Figure 9:
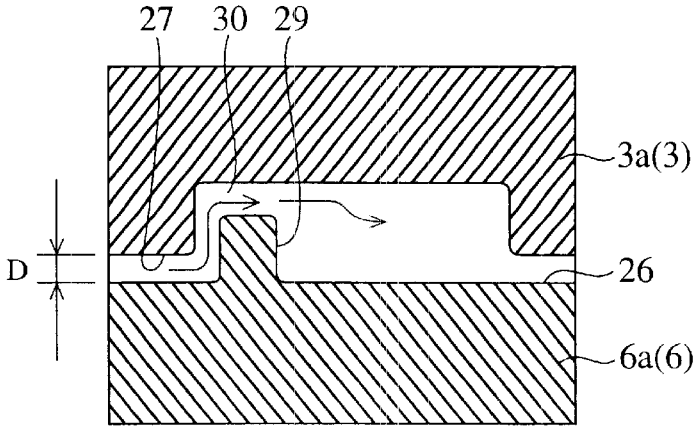
FIG. 9 is an enlarged, lateral cross sectional view of an important point G in the valve timing control device shown in FIG. 8.

FIG. 8 is a lateral cross sectional view of an internal configuration of a valve timing control device as embodiment 3 according to the present invention. FIG. 9 is an enlarged, lateral cross-sectional view of an important point G in the valve timing control device shown in FIG. 8. Components of the embodiment 3 common to those of the related valve timing control device or those of the embodiments 1 and 2 are denoted by the same reference numerals and further description will be omitted.

The embodiment 3 is characterized in that a recess 30 is so arranged at the frontal end 27 of the shoe 3*a* of the case 3 as to extend in a peripheral direction of the case 3. A projection 29 is so arranged at the outer peripheral face of the boss section 6*a* of the rotor 6 as to be inserted into the recess 30. The recess 30 has a depth of not allowing it to make contact with the projection 29 on insertion of the projection 29 into the recess 30. A length of the recess 30 in the peripheral direction is so set as to correspond to an angle greater than or equal to a relative angle of rotation of the rotor 6 to the case 3. The setting prevents an outer wall face of the projection 29 from coming into collision with an inner wall face of the recess 30 when the rotor 6 rotates relatively to the case 3. The recess 30 and the projection 29 constitute a pair of complementary relation.

An operation will be explained hereafter.

The actuating oil in the advanced or retarded hydraulic chamber 8 or 9 undergoes a resistance in a passage which increases as the length of passage is lengthened as indicated by arrow of FIG. 9 in addition to the loss of the kinetic energy in the embodiment 2. Therefore, it is possible to reduce the quantity of oil leaks passing through the between-sealing-faces clearance D.

As described above, according to the embodiment 3, the recess 30 and the projection 29 constituting a pair of complementary relation are arranged. In this way, it is possible to reduce the quantity of oil leaks due to the resistance in the passage increased as the length of passage is lengthened. Therefore, it is possible to keep a responsibility of the device at a high level without reducing extremely the hydraulic pressure.

Moreover, with the embodiment 3, the recess 30 is so arranged at the frontal end 27 of the shoe 3*a* of the case 3 as to extend in the peripheral direction of the case 3. The projection 29 is so arranged at the outer peripheral face of the boss section 6*a* of the rotor 6 as to be inserted into the recess 30. Alternatively, the recess 30 may be arranged at the rotor 6 side, and the projection 29 may be arranged at the case 3 side.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor moving rotationally in synchronization with a crankshaft of an internal-combustion engine and having a plurality of shoes formed at an inner periphery of the first rotor, forming a plurality of hydraulic chambers;

a second rotor arranged rotationally in the first rotor with the first rotor, including a boss section fixed at an end face of a camshaft of the internal-combustion engine and a plurality of vanes arranges at an outer periphery of the boss section and partitioning the hydraulic chambers into advanced side hydraulic chambers and retarded side hydraulic chambers;

a seal means arranged between an outer periphery of each vane of the second rotor and an inner periphery of the first rotor; and a between-sealing-faces clearance defined between a frontal end of each shoe of the first rotor and the outer periphery of the boss section of the second rotor corresponding to the frontal end of the shoe and accepting the quantity of oil leaks having no effect on the responsibility of the device as a maximum values, wherein the between-sealing-face clearance is so set as to be larger than the maximum bearing clearance defined between the camshaft and a bearing section of the device supporting rotationally the camshaft.

2. A valve timing control device according to claim 1, further comprising at least one oil-accumulation groove arranged at any one or both of the outer periphery of the boss section of the second rotor and the frontal end of each shoe of the first rotor.

3. A valve timing control device according to claim 1, further comprising a recess arranged at any one of the outer periphery of the boss section of the second rotor and the frontal end of each shoe of the first rotor, and a projection arranged at the other and allowing insertion of the projection into the recess.

* * * * *